US009105455B2

(12) United States Patent
Brown et al.

(10) Patent No.: US 9,105,455 B2
(45) Date of Patent: Aug. 11, 2015

(54) MULTI INLET FOR SOLVENT ASSISTED INLET IONISATION

(71) Applicant: Micromass UK Limited, Wilmslow (GB)

(72) Inventors: Jeffrey Mark Brown, Hyde (GB); Martin Raymond Green, Cheshire (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/355,848

(22) PCT Filed: Nov. 2, 2012

(86) PCT No.: PCT/GB2012/052733

§ 371 (c)(1),
(2) Date: May 2, 2014

(87) PCT Pub. No.: WO2013/064836

PCT Pub. Date: May 10, 2013

(65) Prior Publication Data

US 2014/0291507 A1 Oct. 2, 2014

Related U.S. Application Data

(60) Provisional application No. 61/556,484, filed on Nov. 7, 2011.

(30) Foreign Application Priority Data

Nov. 2, 2011 (GB) ..... 1118889.3

(51) Int. Cl.
*H01J 49/10* (2006.01)
*H01J 49/04* (2006.01)
*H01J 49/16* (2006.01)

(52) U.S. Cl.
CPC ..... *H01J 49/0468* (2013.01); *H01J 49/0404* (2013.01); *H01J 49/10* (2013.01); *H01J 49/107* (2013.01); *H01J 49/16* (2013.01)

(58) Field of Classification Search
CPC ..... H01J 49/107; H01J 49/04; H01J 49/0404; H01J 49/0468; H01J 49/10; H01J 49/165
USPC ..... 250/281, 282, 283, 285, 288
See application file for complete search history.

(56) References Cited

U.S. PATENT DOCUMENTS 5,825,026 A * 10/1998 Baykut ..... 250/288
6,465,776 B1 * 10/2002 Moini et al. ..... 250/285
6,649,908 B2 * 11/2003 Apffel et al. ..... 250/288

(Continued)

FOREIGN PATENT DOCUMENTS

WO 03104763 12/2003

OTHER PUBLICATIONS

Pagnotti et al, "*Solvent Assisted Inlet Ionization: An Ultrasensitive New Liquid Introduction Ionization Method for Mass Spectrometry*", Analytical Chemistry, vol. 83, No. 11, pp. 3981-3985, 2011.

*Primary Examiner* — Michael Logie
(74) *Attorney, Agent, or Firm* — Diederiks & Whitelaw, PLC

(57) ABSTRACT

A mass spectrometer is disclosed comprising a dual channel Solvent Assisted Inlet Ionisation ("SAII") interface.

14 Claims, 6 Drawing Sheets

(56) References Cited

U.S. PATENT DOCUMENTS

| | | | | |
|---|---|---|---|---|
| 6,841,774 | B1 * | 1/2005 | Weiss | 250/288 |
| 6,914,240 | B2 * | 7/2005 | Giles et al. | 250/285 |
| 6,979,816 | B2 * | 12/2005 | Tang et al. | 250/288 |
| 7,091,477 | B2 * | 8/2006 | Jolliffe et al. | 250/282 |
| 7,196,326 | B2 * | 3/2007 | Franzen et al. | 250/288 |
| 8,080,783 | B2 | 12/2011 | Whitehouse et al. | |
| 2001/0054685 | A1 * | 12/2001 | Franzen | 250/287 |
| 2004/0188605 | A1 * | 9/2004 | Tang et al. | 250/288 |
| 2006/0054805 | A1 * | 3/2006 | Flanagan et al. | 250/288 |
| 2008/0087813 | A1 | 4/2008 | Loucks et al. | |
| 2009/0014641 | A1 * | 1/2009 | Bateman et al. | 250/282 |
| 2009/0072132 | A1 * | 3/2009 | Manri et al. | 250/282 |
| 2009/0090853 | A1 * | 4/2009 | Schoen et al. | 250/282 |
| 2013/0214154 | A1 * | 8/2013 | McEwen et al. | 250/288 |
| 2014/0166875 | A1 * | 6/2014 | Trimpin | 250/282 |

* cited by examiner

MULTI INLET FOR SOLVENT ASSISTED INLET IONISATION

CROSS-REFERENCE TO RELATED APPLICATION

This application is the National Stage of International Application No. PCT/GB2012/052733, filed 2 Nov. 2012, which claims priority from and the benefit of U.S. Provisional Patent Application Ser. No. 61/556,484 filed 7 Nov. 2011 and United Kingdom Patent Application No. 1118889.3 filed on 2 Nov. 2011. The entire contents of these applications are incorporated herein by reference.

BACKGROUND OF THE PRESENT INVENTION

The present invention relates to a mass spectrometer and a method of mass spectrometry. The preferred embodiment relates to Solvent Assisted Inlet Ionization ("SAII").

Solvent Assisted Inlet Ionization is an ionization technique developed by Charles McEwen and Sarah Trimpin and is described Anal. Chem. "Inlet Ionization: A New Highly Sensitive Approach for Liquid Chromatography/Mass Spectrometry of Small and Large Molecules" Vincent S. Pagnotti et al., Sep. 7, 2011.

In SAII analyte, often dissolved in solvent, is introduced directly into a heated metal channel via a fused silica or metal solvent delivery tube. The analyte may pass through a liquid chromatography system prior to entering the inlet. One end of the metal channel is held at a higher pressure than the other end. Generally the metal channel forms the inlet of the mass spectrometer bridging the region from atmosphere to the first sub-atmospheric pressure region. Advantageously, no voltage or laser is required in order to ionise the analyte.

It is desired to provide an improved interface for a mass spectrometer.

SUMMARY OF THE PRESENT INVENTION

According to an aspect of the present invention there is provided a mass spectrometer comprising a dual channel Solvent Assisted Inlet Ionisation ("SAII") interface.

It should be understood that the phrase "dual channel" is intended to cover embodiments wherein the SAII interface comprises two or more channels.

The Solvent Assisted Inlet Ionisation interface is preferably arranged and adapted to ionise analyte without requiring a voltage to be applied to the interface.

A first capillary or fluid supply device for introducing a first substance into the mass spectrometer is preferably received within a first of the dual channels and a second separate capillary or fluid supply device for introducing a second substance into the mass spectrometer is preferably received within a second of the dual channels.

The first and/or second channels preferably comprise metal, glass, quartz, metal coated glass or conductive glass.

The first substance preferably comprises an analyte.

The second substance preferably comprises a reference substance, a calibration substance, a lock mass substance or a reagent.

The first substance is preferably introduced into the first capillary or channel and/or the second substance is preferably introduced into the second capillary or channel via either: (i) a pump; (ii) a Liquid Chromatography ("LC") device; (iii) a Capillary Zone Electrophoresis ("CZE") device; (iv) a Super Critical Fluid ("SCF") chromatography device; or (v) a Gas Chromatography ("GC") device.

In a mode of operation the first substance and the second substance may be introduced simultaneously into the dual channels.

In an alternate mode of operation the first substance and the second substance may be introduced non-simultaneously or discontinuously into the dual channels.

A first end of the interface is preferably maintained at atmospheric pressure and/or a second end of the interface is preferably maintained at a pressure <100 mbar.

According to an embodiment of the present invention a first end of the interface is maintained at a pressure x and the second end of the interface is preferably maintained at a pressure <0.1 x, <0.01 x, <0.001 x or <0.0001 x. According to an embodiment the relative pressure difference between the first end and the second end is at least ×10, ×100, ×1000 or ×10,000.

The second end of the interface is preferably received within a vacuum chamber.

The mass spectrometer preferably further comprises an RF ion guide in the vacuum chamber wherein in use ions are preferably confined radially within the RF ion guide by a pseudo-potential.

The RF ion guide preferably comprises at least a first on guiding path and optionally a separate second ion guiding path.

Ions entering the RF ion guide are preferably directed either into the first ion guiding path or into the second ion guiding path.

According to an embodiment the mass spectrometer preferably further comprises a device which may be switched from an ion transmission mode to an ion attenuation mode thereby preventing or substantially attenuating ions from passing along or exiting the first ion guiding path and/or the second ion guiding path.

Ions directed into the first ion guiding path may be mass analysed by a first mass analyser and ions directed into the second ion guiding path may be mass analysed by a second different mass analyser.

The first ion guiding path and the second ion guiding path may join or converge at a downstream section of the RF ion guide.

The RF ion guide may comprise an ion funnel or ion tunnel ion guide comprising a plurality of electrodes wherein ions are transmitted, in use, through an aperture provided in or defined by each of the electrodes.

The RF ion guide may be operated in a mode of operation such that ions are caused to fragment or react within the RF ion guide.

Ions may be arranged to undergo Electron Transfer Dissociation ("ETD"), Proton Transfer Reaction ("PTR") or gas phase Hydrogen-Deuterium Exchange ("HDx") within the ion guide.

Analyte emerging from the dual channel interface may be directed onto an impact surface in order to assist in desolvation and/or ionisation.

The dual channels may be heated by a common heater and/or may be located within the same tubular heater.

According to another embodiment the dual channels may be located within separate tubular heaters and/or the dual channels are heated independently by separate heaters.

The separate tubular heaters are preferably spaced apart from each other.

According to another aspect of the present invention there is provided a method of mass spectrometry comprising introducing ions into a vacuum chamber of a mass spectrometer via a dual channel Solvent Assisted Inlet Ionisation ("SAII") interface.

According to an aspect of the present invention there is provided a mass spectrometer comprising:

an atmospheric pressure ion source;

a first vacuum chamber;

a first ion inlet, wherein ions from the atmospheric pressure ion source are transmitted in use through the first ion inlet into the first vacuum chamber; and a Solvent Assisted Inlet Ionisation ("SAII") interface leading into the first vacuum chamber or a subsequent downstream vacuum chamber.

The atmospheric pressure ion source may comprise an Electrospray Ionisation ("ESI") ion source, an Atmospheric Pressure Chemical Ionisation ("APCI") ion source, an Atmospheric Pressure Photo-Ionisation ("APPI") ion source or an impact spray ionisation ion source.

The Solvent Assisted Inlet Ionisation ("SAII") interface preferably comprises a single or dual channel Solvent Assisted Inlet Ionisation interface which communicates between an atmospheric pressure region and the first vacuum chamber.

A first capillary or fluid supply device for introducing a first substance into the mass spectrometer is preferably received within the single or dual channel Solvent Assisted Inlet Ionisation interface.

The first substance preferably comprises a reference substance, a calibration substance, a lock mass substance, a reagent or an analyte.

According to an embodiment a single or dual channel SAII interface may be used to perform an internal calibration or mass lock for one or more atmospheric pressure ion sources. The Solvent Assisted Inlet Ionisation ("SAII") interface preferably comprises a single or dual channel linking an atmospheric pressure region with the first vacuum chamber. A first capillary or fluid supply device for introducing a first substance into the mass spectrometer is preferably received within a channel of the interface.

The mass spectrometer preferably further comprises one or more RF ion guides provided in a vacuum chamber downstream of the interface. The one or more RF on guides are preferably arranged and adapted in a mode of operation to keep ions generated by the atmospheric pressure ion source separate from ions generated by or within the Solvent Assisted Inlet Ionisation interface. The one or more RF ion guides may comprise at least a first ion guiding path and a separate second ion guiding path. Ions entering the one or more RF ion guides may be directed either into the first ion guiding path or the second ion guiding path. The first and second on guiding paths may converge or join at a downstream section of the RF ion guide.

The mass spectrometer may further comprise a device which may be switched from an ion transmission mode to an for attenuation mode thereby preventing or substantially attenuating ions from passing along or exiting the first and/or the second ion guiding path. Ions directed into the ion guiding path may be mass analysed by a first mass analyser, and ions directed into the second ion guiding path may be mass analysed by a second mass analyser.

According to an aspect of the present invention there is provided a method of mass spectrometry comprising:

providing an atmospheric pressure ion source, a first vacuum chamber and a first ion inlet;

transmitting ions from the atmospheric pressure ion source through the first ion inlet into the first vacuum chamber; and providing a Solvent Assisted Inlet Ionisation ("SAII") interface leading into the first vacuum chamber or a subsequent downstream vacuum chamber.

According to an aspect of the present invention there is provided a mass spectrometer comprising a single channel Solvent Assisted Inlet Ionisation ("SAII") interface wherein an analyte capillary and a separate reference capillary are inserted within the interface.

According to an aspect of the present invention there is provided a method of mass spectrometry comprising providing a single channel Solvent Assisted Inlet Ionisation ("SAII") interface further comprising:

introducing analyte into the interface via an analyte capillary received within the interface; and introducing a reference substance into the interface via a separate reference capillary received within the interface.

It should be understood that the phrase "dual channel" is intended to cover embodiments wherein the SAII interface comprises two or more channels.

The preferred embodiment relates to a method of introducing two or more separate inlet tubes into a SAII interface. This allows a calibration reference material to be introduced and ionized at the same time as the analyte.

It should be understood that the term "Solvent Assisted Inlet Ionisation" interface should not be construed as including an Electrospray ionisation interface wherein analyte is subjected to a potential difference typically of 2.5-4 kV.

The preferred embodiment comprises an interface comprising two or more heated metal or glass inlet channels. The channels may be separate channels within the same tube or the channels may be provided in separate tubes heated by the same or by separate heater elements.

The preferred embodiment represents an improvement to known SAII apparatus.

The preferred embodiment is particularly concerned with the independent introduction of calibration reference material (lock mass) into a SAII interface. As will be appreciated, this concept can also be applied to a situation in which a single SAII channel is used in conjunction with an atmospheric pressure on source, for example an Electrospray ion source. Accordingly, the SAII channel can be used as a calibration reference or "lock mass" for a separate atmospheric pressure ion source.

The preferred embodiment allows introduction of a separate reference material into the SAII interface thus negating the need to mix reference material with the analyte solution and introducing both through the same solvent delivery tube.

Compared to the known interface the preferred embodiment comprises two or more channels which enable multiple samples simultaneously to be introduced into the SAII interface.

According to an embodiment the mass spectrometer may comprise one or more ion sources selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source, (vii) a Desorption Ionisation on Silicon ("DIOS") ion source; (viii) an Electron Impact ("EI") ion source; (ix) a Chemical Ionisation (CI) ion source; (x) a Field Ionisation ("FI") on source; (xi) a Field Desorption ("FD") ion source; (xii) an Inductively Coupled Plasma ("ICP") on source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source;

(xviii) a Thermospray ion source; (xix) an Atmospheric Sampling Glow Discharge Ionisation ("ASGDI") ion source; (xx) a Glow Discharge ("GD") ion source; and (xxi) an Impact spray ionisation ion source.

The mass spectrometer may further comprise one or more continuous or pulsed ion sources. The mass spectrometer may further comprise one or more ion guides arranged downstream of the interface. The mass spectrometer may further comprise one or more ion mobility separation devices and/or one or more Field Asymmetric Ion Mobility Spectrometer devices arranged upstream and/or downstream of the interface.

The mass spectrometer may further comprise one or more ion traps or one or more ion trapping regions arranged downstream of the interface. The mass spectrometer may further comprise one or more collision, fragmentation or reaction cells arranged downstream of the interface, wherein the one or more collision, fragmentation or reaction cells are selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable on reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The mass spectrometer preferably further comprises a mass analyser selected from the group consisting of (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The mass spectrometer may further comprise one or more energy analysers or electrostatic energy analysers arranged downstream of the interface. The mass spectrometer preferably further comprises one or more ion detectors arranged downstream of the interface.

The mass spectrometer may further comprise one or more mass filters arranged downstream of the interface, wherein the one or more mass filters are selected from the group consisting of (i) a quadrupole mass filter; (ii) a 2D or linear quadrupole ion trap; (iii) Paul or 3D quadrupole ion trap; (iv) a Penning on trap; (v) an ion trap; (vi) a magnetic sector mass filter; (vii) a Time of Flight mass filter; and (viii) a Wein filter.

The mass spectrometer may according to an embodiment further comprise; a C-trap; and an electrostatic mass analyser; wherein in a first mode of operation ions are transmitted to the C-trap and are then injected into the electrostatic mass analyser; and wherein in a second mode of operation ions are transmitted to the C-trap and then to a collision cell or Electron Transfer Dissociation and/or Proton Transfer Reaction device wherein at least some ions are fragmented into fragment ions, and wherein the fragment ions are then transmitted to the C-trap before being injected into the electrostatic mass analyser.

The mass spectrometer may further comprise a stacked ring on guide comprising a plurality of electrodes having an aperture through which ions are transmitted in use and wherein the spacing of the electrodes increases along the length of the ion path. The apertures in the electrodes in an upstream section of the ion guide may have a first diameter and the apertures in the electrodes in a downstream section of the ion guide may have a second diameter which is smaller than the first diameter. Opposite phases of an AC or RF voltage are preferably applied to successive electrodes.

An additional advantage of the solvent assisted inlet ionisation technique is that highly efficient transfer of ions into the mass spectrometer is achieved with relatively small gas flow from atmospheric pressure into the first vacuum stage of the mass spectrometer. The conductance of the heated capillary used for SAII may be far less than the conductance of the sampling orifice used with an atmospheric pressure ion source, for example an Electrospray ion source, whilst still achieving high ion transmission.

This low conductance minimises any extra vacuum pumping requirements introduced when multiple inlet orifices are required from atmosphere into lower pressure regions of the mass spectrometer. This is in contrast to using a single mass spectrometer with multiple sampling orifices and multiple atmospheric ionisation sources where to achieve similar efficiency for each source the conductance from atmosphere to lower pressure increases in direct proportion to the number of sampling orifices.

BRIEF DESCRIPTION OF THE DRAWINGS

Various embodiments of the present invention together with other arrangements given for illustrative purposes only will now be described with reference to the accompanying drawings in which.

DETAILED DESCRIPTION OF PREFERRED EMBODIMENTS

A known Solvent Assisted Inlet Ionisation ("SAII") interface arrangement will first be described.

Figure 1:
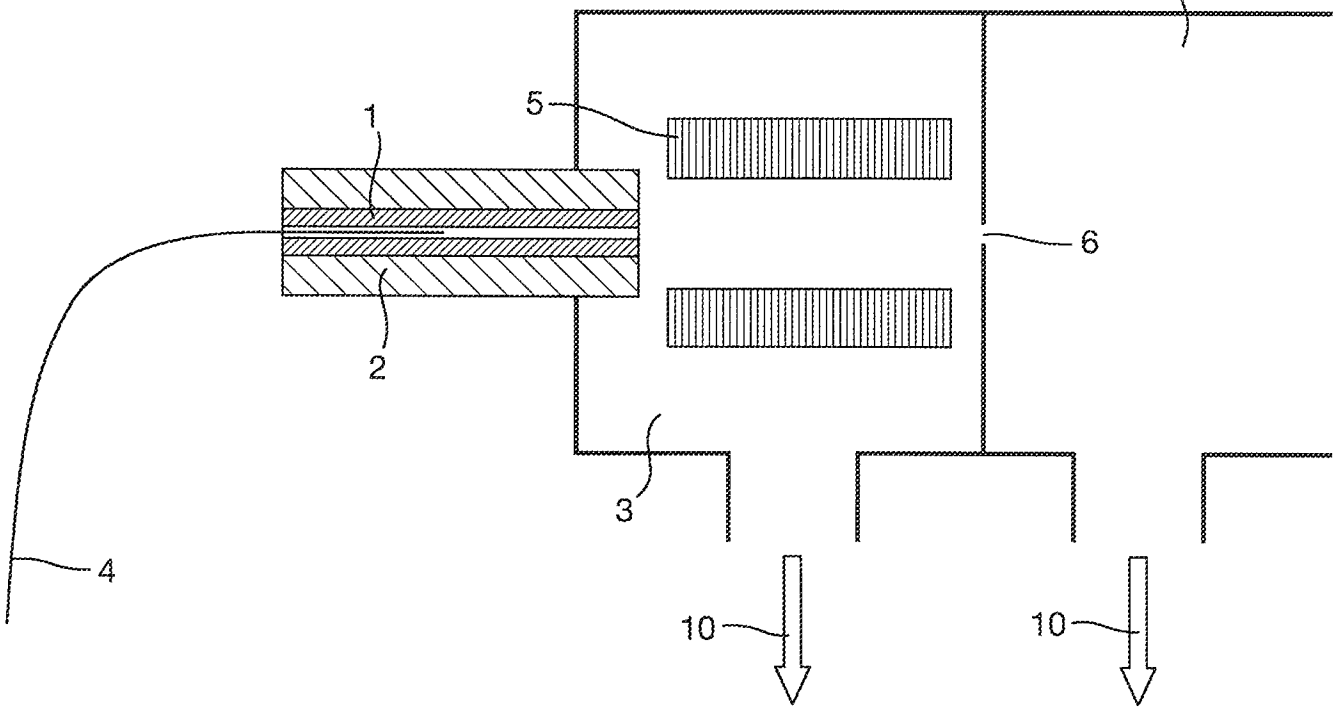
Fig. 1 Prior Art
FIG. 1 shows a known Solvent Assisted Inlet Ionisation ("SAII") interface.

FIG. 1 shows a schematic of a known single channel SAII interface arrangement. The interface arrangement comprises a single channel 1 and is heated to a desired temperature by a heater 2, The heater is capable of heating the channel 1 to 450° C. The inlet end of the single channel 1 is at atmospheric pressure. The outlet end of the single channel 1 is within a first pumped region 3 of a mass spectrometer and is at sub-atmospheric pressure. The pressure in the first pumped region 3 is in the range 1-10 mbar.

A solution comprising analyte and a solvent is introduced into the single channel 1 via a solvent inlet capillary 4 connected to a syringe pump or a liquid chromatography source (not shown). The end of the inlet capillary 4 is carefully positioned within the single channel 1 such that the solvent emerging from the capillary 4 is volatilized as it emerges. Charged droplets continue to desolvate and collide with the surfaces present as they proceed through the heated channel 1 and into the lower pressure region 3. The method of ionization involves droplet charging, desolvation and possibly ion molecule reactions and surface interaction.

It has been shown that this technique is simple and sensitive and produces a range of singly and multiply charged ions with characteristics similar to Electrospray ionization.

A RF ion guide 5 is located in the low pressure region 3. This is not required for operation of the Solvent Assisted Inlet Ionisation interface but allows efficient transfer of ions within this region 3.

An orifice or skimmer 6 separates the first pumped region 3 from a second pumped region 7. The second pumped region 7 is differentially pumped and is maintained at a lower pressure than the first pumped region 3. The pressure of the second pumped region 7 is typically $10^{-2}$-$10^{-3}$ mbar. Further stages of differential pumping may follow this region.

It is known in the context of Time of Flight mass analysers to introduce an internal reference or lock mass during an analytical run. This allows mass drift to be corrected. This drift can occur because of changes in ambient temperature.

Conventionally, a reference material for internal calibration or lock mass is introduced during analysis of an analyte and must be accomplished by mixing the reference material with the analyte and introducing both via the same channel 1 and using the same capillary 4. However, such an approach is problematic since signals may be suppressed due to competition for charge and/or analyte ions may be unresolved from the reference material and hence interfere with the reference material. Additionally, the reference material may require a different solvent to the analyte which cannot be accommodated by this approach.

Various embodiments of the present invention address these problems and further details will now be presented.

Figure 2:
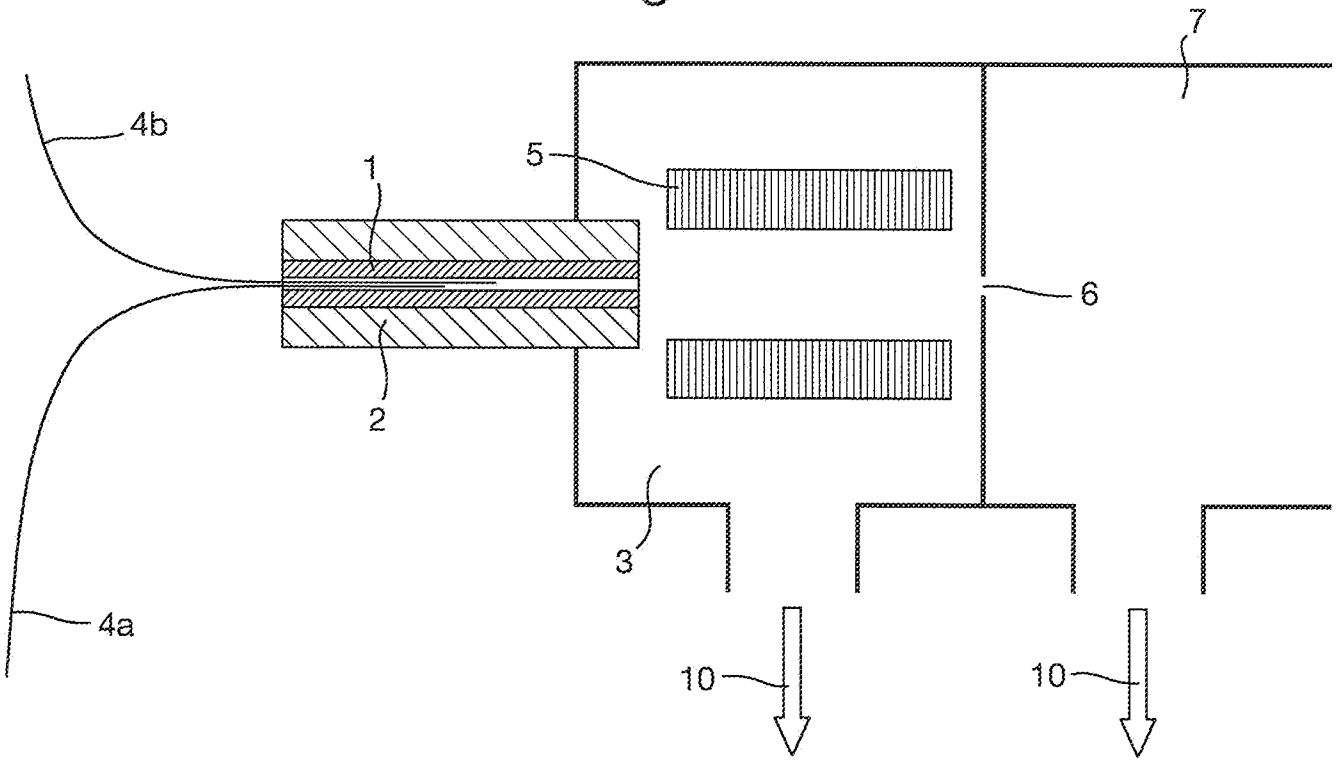
FIG. 2 shows a less preferred embodiment of the present invention wherein separate first and second capillaries are introduced into a single channel of a SAII interface.

Firstly, a less preferred embodiment of the present invention will be described with reference to FIG. 2. FIG. 2 shows a method of introducing reference and analyte according to a less preferred embodiment of the present invention. The interface of FIG. 2 has a single channel 1. In this embodiment separate analyte and reference inlet capillaries 4*a*,4*b* are provided. The capillaries 4*a*,4*b* are introduced into the same heated channel 1. In this case the reference and analyte flow only mixes after volatilization in the channel 1. This has the advantage that a different solvent may be used for the analyte and reference. However, analyte and reference ions will not be separated and hence interference may occur. In addition, with two capillaries 4*a*,4*b* with possibly different flow rates and solvents it may be difficult to optimize the temperature of the channel and/or the position of the capillary within the channel to give best sensitivity and stability for both reference and analyte. Nonetheless, the embodiment shown in FIG. 2 still provides certain advantages over the prior art as shown and described above in relation to FIG. 1.

Figure 3:
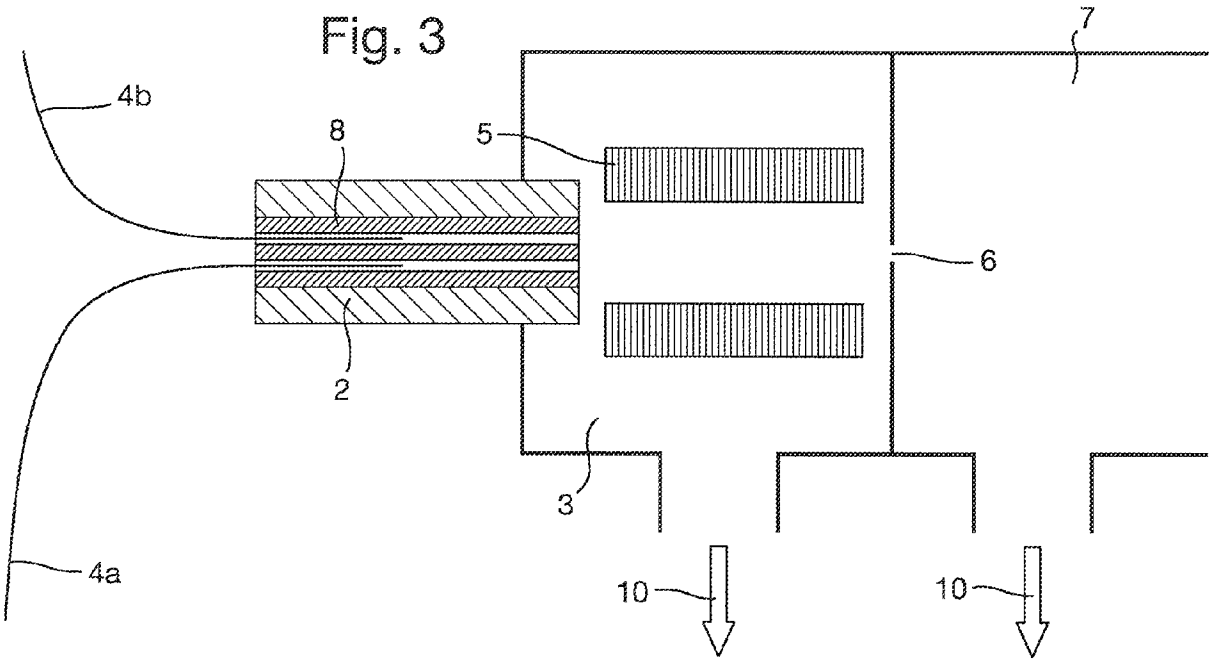
FIG. 3 shows a preferred embodiment of the present invention comprising an SAII interface having two channels, wherein first and second capillaries are positioned within different channels.

FIG. 3 shows a particularly preferred embodiment of the present invention. According to the preferred embodiment a dual channel interface is provided comprising a tube 8 having two (or more) separate channels. The tube 8 is preferably heated with a heater element 2. An analyte capillary 4*a* and a reference capillary 4*b* are preferably independently positioned within separate channels allowing optimisation of stability and sensitivity.

As there are two channels care must be taken that the conductance of the combined tube is not excessive such that a suitable operating pressure is maintained in the vacuum housing 3. Other embodiments are envisaged in which the interface comprises more than two channels.

Figure 4:
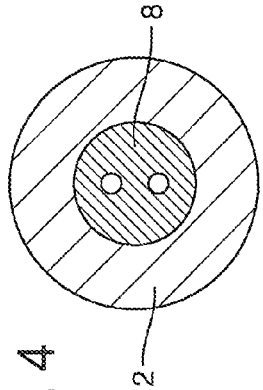
FIG. 4 shows an end face of the dual channel SAII interface as shown in FIG. 3.

FIG. 4 shows an end on diagram of the dual channel tube shown in FIG. 3 and shows the tube 8 and the outer heater 2.

Figure 5:
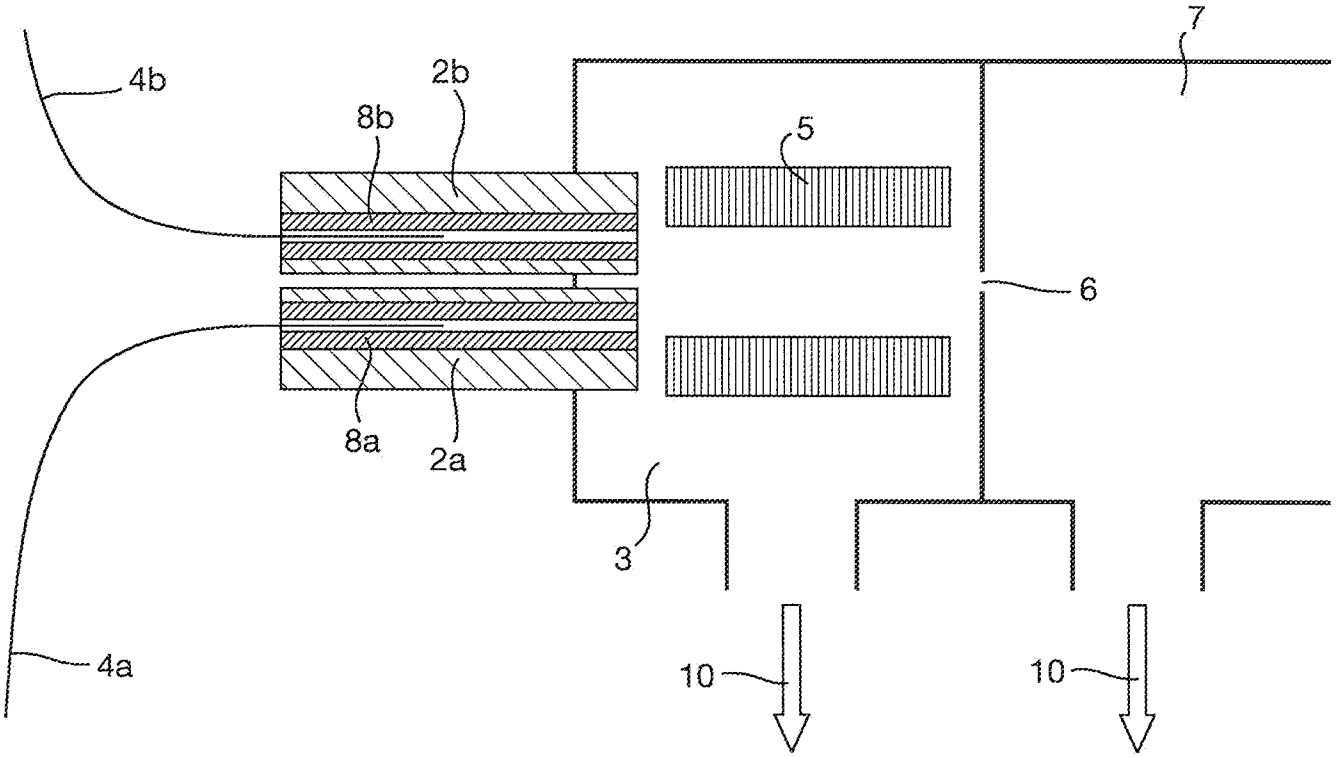
FIG. 5 shows another embodiment of the present invention in which the SAII interface comprises two channels that are separated.

FIG. 5 shows another embodiment of the invention. According to this embodiment two channels 8*a*,8*b* are provided which are physically separate from each other and may be independently heated by separate heaters 2*a*,2*b*. This allows even more flexibility in optimisation of the two inlets. For example, the analyte flow rate from analyte flow 4*a* may be significantly different from the reference flow rate from reference flow 4*b*, and may require a different temperature and or position within the channel.

In the embodiments of FIGS. 2-5, the RF ion guide may be replaced with another type of ion guide, for example an RF confined ion funnel. Such an ion funnel may comprise a plurality of elements each having an aperture (or defining an aperture) through which ions travel in use. The elements may have progressively smaller apertures such that the an ion funnel is formed having an entry at the largest aperture and an exit at the smallest aperture. Alternatively, the RF ion guide may be replaced with a conjoined ion guide comprising, for example, two rows of stacked ring electrodes having parallel ion optical axes but which are radially offset from one another, wherein along the radial dimension the stacked rings are slotted to provide a path for ion movement.

Figure 6:
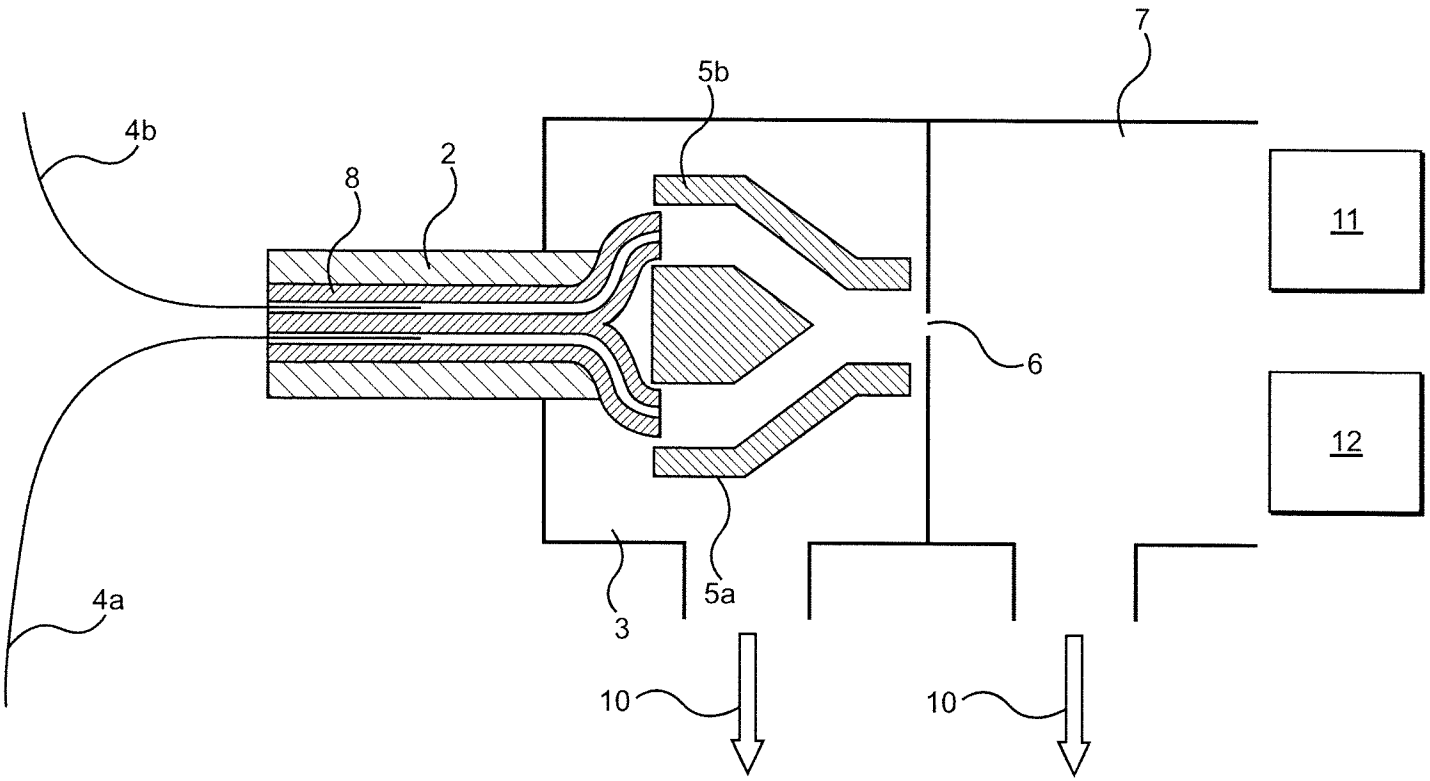
FIG. 6 shows a further embodiment of the present invention wherein a dual channel SAII interface directs ions into different or paths within a RF ion guide.

FIG. 6 shows a further embodiment of the present invention. According to this embodiment a dual channel inlet is provided. However, in this case ions formed by SAII from the reference material are directed to one RF ion guide whilst analyte ions are directed to another RF ion guide. The two ion guides are shown joining each other upstream of a differential pumping aperture 6. This embodiment results in the population of ions in each guide mixing together prior to passing through the orifice 6. It may be the case that the ion populations are, however, kept separate and may be directed to different mass analysers (e.g., mass analysers 11 and 12).

It will be appreciated that the aspects of the embodiment shown and described above in relation to FIG. 6 including directing the outlet ends of different inlet channels to different ion guides, is not limited to the embodiment shown and could equally be applied to the embodiments of FIGS. 3-5 and FIG. 7 (described below).

Moreover, the principle of keeping ions from two different channels separate as described above in relation to FIG. 6 by using independent downstream devices is equally applicable to ions formed by other sub-atmospheric or atmospheric pressure on sources (such as Electrospray Ionisation) as well as SAII. An advantage of using SAII channels, however, is that it is easier to keep the streams of ions separate thus minimising crosstalk between the analyte streams.

In the embodiment of FIG. 6, by suitable application of DC deflection voltages within the separate ion guides, or variation of RF potential, it is possible to prevent ions from either the reference material or the analyte material or from both from passing onwards to the mass analyser.

In this manner, a mode of operation is envisaged where ions from the reference material are allowed to enter the mass analyser periodically to allow correction for mass drift. When ions from the reference are allowed to pass, analyte ions may be prevented from reaching the mass analyser. In this way there is no possibility of interference of the analyte with the reference causing poor mass measurement.

As stated above, it should be noted that the on populations from two channels may be kept separate beyond the first pumping region 3 and may be directed towards different mass analysers.

Figure 7:
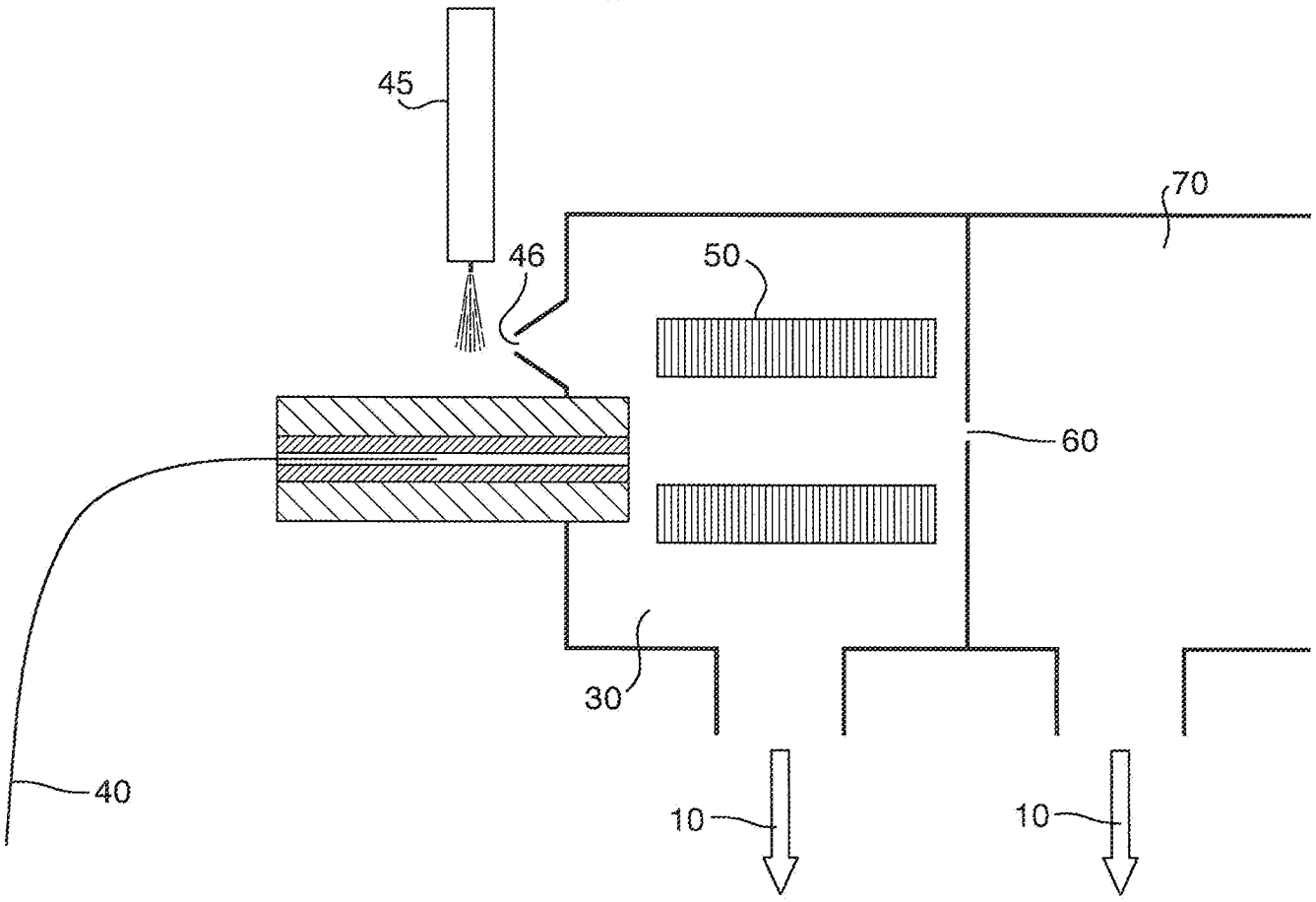
FIG. 7 shows an embodiment wherein a single channel SAII interface is provided together with a conventional Electrospray ion source and interface.

FIG. 7 shows a further embodiment of the present invention. According to this embodiment, an atmospheric pressure ion source 45, for example an Electrospray ion source, is provided in combination with a SAII interface. An ion inlet 46 is provided in the mass spectrometer for transmitting ions from the atmospheric pressure ion source 45 into the first vacuum chamber 30 of the mass spectrometer. An inlet capillary 40 is introduced into a heated SAII channel such that a solvent solution is volatized as it emerges. The SAII interface as shown in FIG. 7 comprises a single SAII channel. Other less preferred embodiments are contemplated wherein the SAII interface may comprise a dual channel SAII interface.

In the same manner as described above, an RF ion guide 50 is preferably provided in the first vacuum chamber 30 and downstream of the ion inlet 46 and SAII channel to guide ions from the first vacuum chamber 30 to a second vacuum chamber 70 of the mass spectrometer. A orifice or skimmer 60 may be provided between the first vacuum chamber 30 and the second vacuum chamber 70.

In this embodiment, the SAII channel can be used to introduce a reference material into the mass spectrometer. The SAII channel can be used as a calibration reference or "lock mass" for the Electrospray on source 45.

The embodiment shown and described with reference to FIG. 7 illustrates an example of the use of SAII when used in conjunction with another type of ion source, specifically an atmospheric pressure Electrospray ion source 45. Using a SAII interface reduces the vacuum pumping requirements of the system since using another atmospheric source as the reference (or further analyte) channel would impose extra vacuum pumping requirements.

Further embodiments are also contemplated wherein no RF ion guide is provided in the first vacuum chamber 30.

In all of the embodiments described above a suitably shaped or positioned impact surface (not shown) may be provided downstream of the channels to assist desolvation and or inlet ionization.

The channel(s) which form the single or dual SAII interface may be made from metal or glass or quartz. Metal coated or conductive glass may also be used.

The one or more channels may be heated resistively, for example by a resistive heater.

In embodiments in which there are more two or more channels, multiple analyte flows can be multiplexed. For example, separate analyte substances may be introduced into separate inlet channels.

According to another embodiment the RF ion guide 5;50 may form a reaction chamber or collision or fragmentation device. For example, ETD reagent ions may be introduced via one channel and analyte ions via another. The ions may then be continuously reacted in the downstream RF confined reaction vessel. Gas phase Hydrogen Deuterium exchange ("HDx") may also be accomplished in the same way.

Substances (e.g. an analyte) may be delivered into an inlet channel via one or more separation techniques either simultaneously or sequentially. For example, techniques such as Liquid Chromatography ("LC"), Capillary Zone Electrophoresis ("CZE"), Super Critical Fluid ("SCF") chromatography or Gas Chromatography ("GC") may be used.

When using a separation technique as described above, eluent from a separation device may be split between more than one inlet channel after separation such that different analytes are introduced into separate inlet channels. A delay in introduction time for the different analytes may be achieved, for example, by increasing the length of transfer line between the separation device (e.g. a chromatograph) and the inlet channels.

Ions from one channel may then be monitored whilst ions from the other channel may be prevented from entering the mass analyser. The signal from a first channel can be used for data dependent control of the mass spectrometer for analysis of ions from a second channel. For example, transmission of ions may be alternated between analyte introduced into each channel.

The signal associated with the channel for which ions appear earliest in time may be used to determine the MS-MS precursor mass set for ions from the second channel before these ions have appeared. Other data dependent functions and combinations may be envisaged e.g. control of downstream ion transmission to control space charge or detection saturation effects.

Yet further embodiments are contemplated wherein other atmospheric ionisation techniques may be combined with SAII. For example, a multiple inlet interface may be provided wherein one or more inlets is a SAII interface and one or more other channels or openings accept ions produced by or generated from a different atmospheric ionisation technique e.g. example Electrospray Ionisation ("ESI"), Atmospheric Pressure Chemical Ionisation ("APCI") or Atmospheric Pressure Photo-Ionisation ("APPI"). For example, SAII may be used as a simple lock mass interface for another API ionisation method.

In addition, the principle of keeping ions from two different ionisation inlets separate using independent downstream RF devices is applicable to ions formed by sub ambient ionisation techniques (such as sub ambient Electrospray) and to atmospheric pressure ion sources as well as SAII The advantage of SAII is that it is easier to keep the streams of ions separate thus minimising cross talk between analyte streams.

Introduction of reference or calibration material and or analyte material may be discontinuous. For example, a quantity of pure solvent or gas may be introduced into the flow of sample using a switched divert valve upstream of any LC delivery system and downstream of the SAII interface. This produces a discontinuity within the sample flow. In the case of an introduced gas this discontinuity represents a gap in the column of fluid travelling towards the interface. In the case of solvent introduction the discontinuity represents a region in which analyte molecules are not present.

The result of this approach is to allow the appearance of analyte or reference ions to be gated such that analyte and reference ions do not appear at the same time downstream in the mass analyser. This avoids the potential for mass interference between analyte and calibrant signals. In addition, using this approach it is possible to introduce a region of reference material into the flow of analyte allowing both reference and analyte to be introduced discontinuously via the same SAII interface. These approaches are not limited to SAII and may be used to introduce reference material into any API ion source.

Although the preferred embodiment relates to SM, embodiments of the present invention are contemplated using ESI and API sources in combination with a single channel or multiple channel SAII interface.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising a dual channel Solvent Assisted Inlet Ionisation ("SAII") interface;

wherein said dual channels are heated independently by separate heaters.

2. A mass spectrometer as claimed in claim 1, wherein said Solvent Assisted Inlet Ionisation interface is arranged and adapted to ionise analyte without requiring a voltage to be applied to said interface.

3. A mass spectrometer as claimed in claim 1, wherein a first capillary or fluid supply device for introducing a first substance into said mass spectrometer is received within a first of said dual channels and a second separate capillary or fluid supply device for introducing a second substance into said mass spectrometer is received within a second of said dual channels.

4. A mass spectrometer as claimed in claim 3, wherein said first substance comprises an analyte, wherein optionally said second substance comprises a reference substance, a calibration substance, a lock mass substance or a reagent.

5. A mass spectrometer as claimed in claim 3, wherein in a mode of operation said first substance and said second substance are introduced simultaneously,non-simultaneously or discontinuously into said dual channels.

6. A mass spectrometer as claimed in claim 1, wherein in use a first end of said interface is maintained at atmospheric pressure or wherein a second end of said interface is maintained at a pressure <100 mbar, wherein optionally said second end of said interface is received within a vacuum chamber.

7. A mass spectrometer as claimed in claim 6, further comprising an RF ion guide in said vacuum chamber wherein in use ions are confined radially within said RF ion guide by a pseudo-potential.

8. A mass spectrometer as claimed in claim 7, wherein said RF ion guide comprises at least a first ion guiding path and a separate second ion guiding path, wherein optionally ions entering said RF ion guide are directed either into said first ion guiding path or into said second ion guiding path.

9. A mass spectrometer as claimed in claim 8, wherein ions directed into said first ion guiding path are mass analysed by a first mass analyser and ions directed into said second ion guiding path are mass analysed by a second different mass analyser.

10. A mass spectrometer as claimed in claim 8, wherein said first ion guiding path and said second ion guiding path join or converge at a downstream section of said RF ion guide.

11. A mass spectrometer as claimed in claim 7, wherein said RF ion guide is operated in a mode of operation such that ions are caused to fragment or react within said RF ion guide.

12. A mass spectrometer as claimed in claim 1, wherein analyte emerging from said Solvent Assisted Inlet Ionisation ("SAII") interface is directed onto an impact surface in order to assist in desolvation or ionisation.

13. A mass spectrometer as claimed in claim 1, wherein said separate tubular heaters are spaced apart from each other.

14. A method of mass spectrometry comprising:

introducing ions into a vacuum chamber of a mass spectrometer via a dual channel Solvent Assisted Inlet Ionisation ("SAII") interface; and heating said dual channels independently by separate heaters.

* * * * *